US006249566B1

(12) United States Patent
Hayashi et al.

(10) Patent No.: US 6,249,566 B1
(45) Date of Patent: Jun. 19, 2001

(54) APPARATUS FOR X-RAY ANALYSIS

(75) Inventors: Seiichi Hayashi, Yokohama; Jimpei Harada; Kazuhiko Omote, both of Tokyo, all of (JP)

(73) Assignee: Rigaku Corporation, Tokyo (JP)

( * ) Notice: Subject to any disclaimer, the term of this patent is extended or adjusted under 35 U.S.C. 154(b) by 0 days.

(21) Appl. No.: 09/270,169

(22) Filed: Mar. 16, 1999

(30) Foreign Application Priority Data

Mar. 20, 1998 (JP) ..... 10-090603
May 14, 1998 (JP) ..... 10-148260

(51) Int. Cl.[7] ..... G21K 1/06
(52) U.S. Cl. ..... 378/85; 378/84
(58) Field of Search ..... 378/84, 85

(56) References Cited

U.S. PATENT DOCUMENTS

| | | | | |
|---|---|---|---|---|
| 4,525,853 | | 6/1985 | Keem et al. | 378/84 |
| 4,693,933 | | 9/1987 | Keem et al. | 428/333 |
| 5,020,086 | | 5/1991 | Peugeot | 378/113 |
| 5,604,782 | * | 2/1997 | Cash, Jr. | 378/85 |
| 5,646,973 | | 7/1997 | Gutman | 378/84 |
| 5,757,882 | | 5/1998 | Gutman | 378/84 |
| 5,799,056 | | 8/1998 | Gutman | 378/84 |
| 6,014,423 | * | 1/2000 | Gutman et al. | 378/85 |
| 6,041,099 | * | 3/2000 | Gutman et al. | 378/85 |

FOREIGN PATENT DOCUMENTS 6-46240 6/1994 (JP) .

OTHER PUBLICATIONS

M. Schuster and H. Gobel, "Parallel–Beam Coupling Into Channel–Cut Monochromators Using Curved Graded Multilayers", J. Phys. D: Appl. Phys. 28 (1995) A270–A275, Printed in U.K.

G. Gutman and B. Verman, "Comment, Calculation of Improvement to HRXRD System Through–Put Using Curved Graded Multilayers", J. Phys. D: Appl. Phys. 29 (1996) 1675–1676, Printed in U.K.

M. Schuster and H. Gobel, Reply to Comment, Calculation of Improvement to HRXRD System Through–Put Using Curved Graded Multilayers, J. Phys. D: Appl. 29 (1996) 1677–1679, Printed in U.K.

V. E. Cosslett and W. C. Nixon, "X–Ray Microscopy", Cambridge at the University Press, 1960, pp. 105–109.

S. Flügge, "Encyclopedia of Physics", vol. XXX, X–rays, Springer–Verlag, Berlin·Gottingen·Heidelberg, 1957, pp. 324–325.

* cited by examiner

*Primary Examiner*—Robert H. Kim
*Assistant Examiner*—Allen C Ho
(74) *Attorney, Agent, or Firm*—Frishauf, Holtz, Goodman, Langer & Chick, P.C.

(57) ABSTRACT

An incident monochromator and a microfocus X-ray source with an apparent focal spot size of less than 30 micrometers are combined so that the X-ray source can be close to the monochromator and the intensity of X-rays focused on a sample is greatly increased. A side-by-side composite monochromator is arranged between the X-ray source and the sample. The composite monochromator has a first and a second elliptic monochromators each having a synthetic multilayered thin film with graded d-spacing. The first elliptic monochromator has one side which is connected to one side of the second elliptic monochromator. A preferable apparent focal spot size D of the X-ray source may be 10 micrometers. Because the invention provides a high focusing efficiency for X-rays, it is not required to use a high-power X-ray tube. The X-ray tube according to the invention, moreover, may have a stationary-anode, whose power may be about 7 Watts.

29 Claims, 11 Drawing Sheets

APPARATUS FOR X-RAY ANALYSIS

BACKGROUND OF THE INVENTION

This invention relates to an apparatus for X-ray analysis which uses a composite monochromator having combined two elliptic monochromators, the composite monochromator being arranged between an X-ray source and a sample.

In the field of X-ray analysis, there has always been required to make the X-ray intensity as high as possible. A stationary-anode X-ray tube (e.g., 0.4 mm×12 mm in focal spot size and 2.2 kW in maximum power) has a limit for increasing the X-ray intensity. To overcome this limitation, a rotating-anode X-ray tube which provides a higher X-ray intensity has been developed and used. There has also been used synchrotron radiation which provides a much higher X-ray intensity. The X-ray generator having such a higher X-ray intensity, however, is big and complicated in handling, and further spends much energy. Under the circumstances, there is more and more of a need to develop an apparatus for X-ray analysis which can increase the X-ray intensity on a sample even though it can be handled easily in laboratories.

Assuming that a sample is set at a distance of several hundred millimeters apart from an X-ray source and an X-ray beam is incident on the sample directly from the X-ray source, the sample receives only a very small percentage of the X-rays which are emitted in all directions from the focal spot on the target of the X-ray source. Accordingly, it is known that optical elements such as mirrors or monochromators are used to focus X-rays on the sample. Persons in the art have sought for an improved focusing efficiency of such an X-ray optical system to save energy further.

Elliptic or parabolic focusing elements with a synthetic multilayered thin film have recently been developed and given attention by persons in the field of X-ray analysis, the elements having high focusing efficiencies and high reflectivity for X-rays of a predetermined wavelength of interest. The focusing elements of this type are disclosed, for example, in U.S. Pat. Nos. 5,799,056; 5,757,882; 5,646,976; and 4,525,853; and M. Schuster and H. Gobel, "Parallel-Beam Coupling into Channel-Cut Monochromators Using Curved Graded Multilayers", J. Phys. D: Appl. Phys. 28(1995)A270–A275, Printed in the UK; G. Gutman and B. Verman, "Comment, Calculation of Improvement to HRXRD System Through-Put Using Curved Graded Multilayers", J. Phys. D: Appl. Phys. 29(1996)1675–1676, Printed in the UK; and M. Schuster and H. Gobel, "Reply to Comment, Calculation of Improvement to HRXRD System Through-Put Using Curved Graded Multilayers", J. Phys. D: Appl. Phys. 29(1996)1677–1679, Printed in the UK. There are further disclosed structures of the synthetic multilayered thin film for X-ray reflection and methods for producing them, for example, in Japanese Patent Post-Exam Publication No. 94/46240 and U.S. Patent No. 4,693,933.

The synthetic multilayered thin film acts as a focusing monochromator for X-rays. It is certain that a combination of an ordinary X-ray source and the above focusing-type synthetic multilayered thin film may greatly increase the X-ray intensity on a sample.

There will now be described with reference to FIGS. 5 to 12 the shape, structure and function of the prior-art elliptic monochromator having the synthetic multilayered thin film. First, the meaning of the terms "elliptic monochromator", "elliptic-arc surface" and "focal axis" will be described. Referring to FIG. 5, a three-dimensional rectangular coordinate axis XYZ is set in space and an ellipse 10 is drawn in an XY-plane. Imagining a curve 12 which is a portion of the ellipse 10, the curve 12 is referred to hereinafter as "elliptic-arc". The elliptic-arc 12 is translated in the Z-direction (i.e., the direction perpendicular to the plane including the elliptic-arc 12) to make a trace which becomes a curved surface 14. The curved surface 14 is referred to hereinafter as "elliptic-arc surface". The two foci $F_1$ and $F_2$ of the elliptic-arc surface 12 are translated in the Z-direction to make two traces 20 and 22 each of which is referred to hereinafter as "focal axis". The focal axes 20 and 22 of the elliptic-arc surface 14 become parallel to the Z-axis. A normal line drawn at any point on the elliptic-arc surface 14 becomes always parallel to the XY-plane. Under the above positional relationship, the elliptic-arc surface 14 can be represented by "elliptic-arc surface with focal axes parallel to the Z-axis". It should be noted that the monochromator whose reflecting surface consists of an elliptic-arc surface is referred to simply as "elliptic monochromator".

Next, the function of the elliptic monochromator will be described. Referring to FIG. 6, imagine an elliptic monochromator 24 with focal axes parallel to the X-axis. The drawing sheet of FIG. 6 is parallel to the YZ-plane. The reflecting surface 26 of the elliptic monochromator 24 appears as an elliptic-arc on the drawing sheet of FIG. 6. In view of geometrical optics, a light ray emitted from a light source, which is positioned at one focal point $F_1$ of the elliptic-arc, is reflected at the reflecting surface 26 and reach the other focal point $F_2$.

In view of X-ray optics, an X-ray emitted from an X-ray source, which is positioned at one focal point $F_1$, may be reflected at the reflecting surface 26 only when an X-ray incidence angle $\theta$ on the reflecting surface 26, an X-ray wavelength $\lambda$ and the lattice spacing d of crystal of the reflecting surface 26 satisfy the Bragg equation for diffraction. The reflected X-ray will reach the other focal point $F_2$. It should be noted that the lattice surfaces of crystal contributing to the diffraction are parallel to the reflecting surface 26.

Incidentally, the X-ray incidence angle $\theta$ on the reflecting surface 26 depends upon the position, on which an X-ray is incident, of the reflecting surface 26 of the elliptic monochromator 24. Therefore, to satisfy the Bragg equation at any point of the reflecting surface 26, the lattice spacing must be graded along the elliptic-arc (i.e., must vary with the incidence angle $\theta$). The elliptic monochromator for X-rays has accordingly a synthetic multilayered thin film in which the d-spacing of the multilayers varies continuously. The d-spacing varying continuously is referred to hereinafter as graded d-spacing.

FIG. 7 shows the functional principle of the elliptic monochromator having graded d-spacing. X-rays emitted from the X-ray source 32 are incident on a point A, having d-spacing $d_1$, of the reflecting surface 26 of the elliptic monochromator 24 with an incidence angle $\theta_1$ and on a point B having d-spacing $d_2$ with an incidence angle $\theta_2$. The Bragg equation at the point A is $$2d_1\sin\theta_1=\lambda \tag{1}$$

where $\lambda$ is the wavelength of the X-rays. The Bragg equation at the point B is $$2d_2\sin\theta_2=\lambda. \tag{2}$$

If the positional relationship between the X-ray source 32 and the elliptic monochromator 24 is predetermined, the incidence angle $\theta$ could be calculated at any point of the reflecting surface 26 of the elliptic monochromator 24, and accordingly the d-spacing for every incidence angle θ could also be calculated so as to satisfy the Bragg equation.

With the use of such an elliptic monochromator having the graded d-spacing, X-rays of a particular wavelength of interest always satisfy the Bragg equation even if the X-rays are incident on any point of the reflecting surface, so that the reflected X-rays of the particular wavelength can be focused at the other focal point $F_2$. The elliptic monochromator having such a synthetic multilayered thin film per se is known as mentioned above.

Referring to FIG. 6, X-rays, emitted from the focal point $F_1$ and traveling in the direction within a divergence angle α, are reflected by the reflecting surface 26 of the elliptic monochromator 26 and focused on the other focal point $F_2$ with a convergence angle β. With such a focusing effect, X-rays with the predetermined divergence angle can be utilized effectively, so that the X-ray intensity on the focal point $F_2$ may be greatly increased as compared with the case of no elliptic monochromator. At the same time, X-rays may be purified into the specific monochromatic rays with the function of the elliptic monochromator 24.

While we have considered, with reference to FIG. 6, the focusing of the X-rays which diverge in the XY-plane, the focusing of the X-rays which diverge in the ZX-plane can be realized when we use an "elliptic monochromator with focal axes parallel to the Y-axis". Accordingly, if both the "elliptic monochromator with focal axes parallel to the X-axis" and the "elliptic monochromator with focal axes parallel to the Y-axis" are arranged between the X-ray source and the sample, the focusing for both the divergence in the YZ-plane and the divergence in the ZX-plane can be realized. Under such an arrangement, the X-ray source must be positioned on one focal point of the "elliptic monochromator with focal axes parallel to the X-axis" and at the same time on one focal point of the "elliptic monochromator with focal axes parallel to the Y-axis" too.

One arrangement of the elliptic monochromator system which can focus X-rays in both the YZ-plane and the ZX-plane may be a sequential arrangement as shown in FIG. 8A. This arrangement is disclosed in by V. E. Cosslett and W. C. Nixon, "X-ray Microscopy", Cambridge at the University Press, 1960, pp.105–109. Referring to FIG. 8A, X-rays emitted from an X-ray source 32 are reflected first at the first elliptic monochromator 34 (the elliptic monochromator with focal axes parallel to the X-axis) so that the divergence in the YZ-plane is focused. The X-rays are reflected next at the second elliptic monochromator 36 (the elliptic monochromator with focal axes parallel to the Y-axis) so that the divergence in the ZX-plane is focused.

Another arrangement is a side-by-side arrangement as shown in FIG. 8B and this arrangement is disclosed in S. Flugge, "Encyclopedia of Physics", Volume XXX, X-rays, Springer-Verlag, Berlin•Gottingen•Heidelberg, 1957, pp.324–32. The side-by-side elliptic monochromator system has the first elliptic monochromator 38 (the elliptic monochromator with focal axes parallel to the X-axis) and the second elliptic monochromator 40 (the elliptic monochromator with focal axes parallel to the Y-axis), these monochromators being so combined that one side of the first monochromator 38 is in contact with one side of the second monochromator 40. X-rays emitted from an X-ray source 32 are reflected first at either one of the first elliptic monochromator 38 and the second elliptic monochromator 40, and further reflected, soon after the first reflection, at the other monochromator, so that the X-rays are focused on a convergence point 44. X-rays emitted from the X-ray source 32 must first impinge on the region 42 as indicated by hatching for enabling the sequential reflection on the two elliptic monochromators 38 and 40. Thus, the side-by-side composite monochromator utilizes the sequential reflection at the region 42 near the corner between the two monochromators.

FIG. 9A is a view taken in the X-direction of FIG. 8B, and FIG. 9B is a view taken in the Y-direction of FIG. 8B. In FIGS. 9A and 9B, X-rays emitted from the X-ray source 32 are reflected first at a point C on the reflecting surface of the first elliptic monochromator 38 and reflected next at a point D on the reflecting surface of the second elliptic monochromator 40, so that the X-rays are focused on the convergence point 44.

In another route as shown in FIGS. 10A and 10B, X-rays emitted from the X-ray source 32 are reflected first at a point E on the reflecting surface of the second elliptic monochromator 40 and reflected next at a point F on the reflecting surface of the first elliptic monochromator 38, so that the X-rays are focused on the convergence point 44.

Referring back to FIG. 8B, when seen in the X-direction, the X-ray source 32 is positioned at one focal point of the first elliptic monochromator 38, while the convergence point 44 is on the other focal point. On the other hand, when seen in the Y-direction, the X-ray source 32 is positioned at one focal point of the second elliptic monochromator 40, while the convergence point 44 is on the other focal point.

By the way, in FIG. 8B, when X-rays are incident first on any point which is out of the hatching region 42, the reflected X-rays from that point do not impinge on the other elliptic monochromator any longer. Such X-rays can not reach the convergence point 44. Stating in detail, when X-rays are incident first on any point, on the reflecting surface of the first elliptic monochromator 38, which is out of the region 42, the reflected X-rays from that point are focused on a line 46 (parallel to the X-axis). On the other hand, when X-rays are incident first on any point, on the reflecting surface of the second elliptic monochromator 40, which is out of the region 42, the reflected X-rays from that point are focused on a line 48 (parallel to the Y-axis). It is noted that the convergence point 44 is located at the intersection of an extension of the line 46 and an extension of the line 48. If a sample is set on the convergence point 44, only X-rays which are focused in both the YZ-plane and the ZX-plane may irradiate the sample.

With the sequential-type composite monochromator as shown in FIG. 8A, a divergence angle, with which X-rays are caught by the composite monochromator, in the YZ-plane is different from a divergence angle in the ZX-plane. On the contrary, with the side-by-side composite monochromator as shown in FIG. 8B, a divergence angle, with which X-rays are caught by the composite monochromator, in the YZ-plane is equal to a divergence angle in the ZX-plane because the distances between the X-ray source 32 and the two monochromators 38 and 40 are equal to each other.

Referring to FIG. 11 which illustrates an effect of the focal spot size of an X-ray source, when an X-ray source 32 is positioned at one focal point of the reflecting surface of an elliptic monochromator 24, X-rays emitted from the X-ray source 32 are incident on a point A on the reflecting surface of the elliptic monochromator 24 with an incidence angle θ. The incidence angle θ depends upon where the X-rays impinge on along the elliptic-arc of the reflecting surface of the elliptic monochromator 24. Because the elliptic monochromator 24 has the graded d-spacing along the curve, the d-spacing, the X-ray wavelength λ of interest and the incidence angle θ at any point A satisfy the Bragg equation as described above. By the way, the X-ray source 32 has an apparent focal spot size D as viewed from the point A, and accordingly the incidence angle θ at the point A has an angular width Δθ (breadth of incidence angle) of a certain extent. As to the breadth Δθ the following equation (3) is obtained:

$$D/2=S\cdot\sin(\Delta\theta/2) \quad (3)$$

where S is the distance between the X-ray source 32 and the point A, and D is the apparent focal spot size of the X-ray source 32. Because Δθ is very small, sin(Δθ/2) is approximately equal to Δθ/2, noting that the unit for Δθ is the radian, and the following equation (4) is obtained:

$$D=S\cdot\Delta\theta. \quad (4)$$

Next, the wavelength selectivity of the monochromator will be explained. A graph shown in FIG. 12 indicates the relationship between the incidence angle θ of X-rays at the point A and the intensity of the diffracted X-rays (i.e., reflected X-rays) therefrom. The abscissa represents the incidence angle θ and the ordinate represents the intensity of the diffracted X-rays. With the monochromator having the synthetic multilayered thin film, the half-value width ϵ of the diffraction peak observed is about 0.001 radian. If the breadth Δθ of the incidence angle θ of incident X-rays is more than the half-value width ϵ, a portion of X-rays, which has an incidence angle out of the half-value width ϵ, will not satisfy the Bragg equation so as not to contribute to the diffracted intensity.

In the above equation (4), substituting the half-value width ϵ=0.001 radian for Δθ and 0.5 mm for the focal spot size D leads to that the distance S between the X-ray source and the point A becomes 500 mm. It could be understood that when there is used an X-ray source with an apparent focal spot size of 0.5 mm, the distance S between the X-ray source and the point A should be more than 500 mm for the purpose of narrowing the breadth Δθ of the incidence angle θ of X-rays at the point A into the above half-value width ϵ of the monochromator. If the distance S is less than 500 mm, the breadth Δθ of incidence angle, which depends on the X-ray focal spot size, becomes larger than the half-value width ϵ, so that a portion of the X-rays which are incident on the point A will not satisfy the Bragg equation and will not contribute to the intensity of the diffracted X-rays any longer. Therefore, in FIG. 11, the distance S is required to be more than 500 mm for the purpose of effectively utilizing the intensity of X-rays which are incident on the elliptic monochromator 24. It would be noted further that the minimum distance between the X-ray source 32 and the elliptic monochromator 24 should be more than 500 mm so that the distance S for every point on the reflecting surface of the elliptic monochromator 24 is more than 500 mm.

There will now be discussed the divergence angle α with which X-rays are caught by the elliptic monochromator 24. As the distance between the X-ray source 32 and the elliptic monochromator 24 increases, the divergence angle α decreases. As the distance decreases, the divergence angle α increases. Further, as the divergence angle α increases, the intensity of the X-rays which are focused by the elliptic monochromator 24 increases. Accordingly, for the purpose of increasing the intensity of the focused X-rays, the distance between the X-ray source 32 and the elliptic monochromator 24 should be smaller. However, for the purpose of narrowing the breadth Δθ of incidence angle, which depends on the apparent focal spot size D of the X-ray source, into the half-value width ϵ mentioned above, the distance between the X-ray source 32 and the elliptic monochromator 24 should be larger.

After all, even with the use of the elliptic monochromator, there has been the above-described opposite requirements for the purpose of increasing the intensity of the focused X-rays, so that increasing such an intensity has been limited.

Accordingly, an object of the present invention is to provide apparatus for X-ray analysis with which a sample may be irradiated by X-rays of a higher intensity than before in the case of using the elliptic monochromator to focus X-rays on the sample.

SUMMARY OF THE INVENTION

Investigating the characteristics of the focusing-type synthetic multilayered thin film, we have found what the focal spot size of an X-ray source should be in using such a focusing element. As a result of our investigation, we have confirmed that a combination of a microfocus X-ray tube with a focal spot size of less than 30 micrometers and a focusing-type monochromator with a synthetic multilayered thin film leads to a focused X-ray beam with a good quality and a high intensity which is substantially equal to that in the case of using a 6-kW rotating-anode X-ray generator with a focal spot size of 0.3 mm×0.3 mm. Although an X-ray source and a focusing optical element have been considered, in the art, to be separate elements, the present invention provides an integral design comprising of these two elements.

Apparatus for X-ray analysis in accordance with the invention is characterized in a combination of a composite elliptic monochromator with a specific structure and a microfocus X-ray source with an apparent focal spot size of less than 30 micrometers. The composite monochromator comprises of a first elliptic monochromator and a second elliptic monochromator. The reflecting surface of the first elliptic monochromator is an elliptic-arc surface with focal axes substantially parallel to the X-direction, while the reflecting surface of the second elliptic monochromator is an elliptic-arc surface with focal axes substantially parallel to the Y-direction. Although it is preferable that the focal axes of the two elliptic monochromator intersect at right angles, it is allowable in practice that the angle of intersection may be apart from right angles within a range of about ±10 degrees.

The first elliptic monochromator has one side which is connected to one side of the second elliptic monochromator. It is acceptable that the two sides are connected to each other not only with a fitted condition in the longitudinal direction but also with a partly-translated condition of a certain extent (i.e., within a range of about one fourth of the length of the elliptic monochromator) in the longitudinal direction.

An X-ray source is positioned at the first focal points of the two elliptic monochromators. A sample is to be set at or near, in the direction of the optical axis, the second focal points of the elliptic monochromators. The sample is not required to be located exactly on the second focal points and is allowed to be located near (namely, in the direction of the optical axis) the second focal point as far as it may be irradiated by X-rays from the monochromator.

The first and second elliptic monochromators have synthetic multilayered thin films. The period of the multilayers varies continuously along the elliptic-arc so as to satisfy the Bragg equation for the X-ray wavelength of interest at any point of the reflecting surface.

A microfocus X-ray source with an apparent focal spot size of less than 30 micrometers per se is known. For example, an X-ray source with a focal spot size of about 10 to 20 micrometers is disclosed in U.S. Pat. No. 5,020,086. Such a microfocus X-ray source has been utilized for (1) obtaining an enlarged transmission image of a very small region of a sample with an X-ray source being close to the very small region of the sample; and (2) scanning both a sample and a two-dimensional detector and observing the sample while being irradiated by small-spot X-rays, the X-rays being emitted from the X-ray source and focused by a capillary, i.e., an X-ray microscope.

The present invention succeeds in increasing an X-ray intensity on a sample by means of combining a composite monochromator comprises two elliptic monochromators having synthetic multilayered thin films and a microfocus X-ray source. In this situation, the characteristics of the microfocus X-ray source (i.e., a very small apparent focal spot size) come in useful. Using the microfocus X-rays with a focal spot size of less than 30 micrometers, even when the distance between the X-ray source and the monochromator becomes smaller, the breadth $\Delta\theta$ of incidence angle, which depends upon the apparent focal spot size of the X-ray source, becomes within the range of the half-value width $\epsilon$ of the diffraction peak of the elliptic monochromator, so that the X-rays reaching the elliptic monochromator are utilized effectively with no loss. Furthermore, because the distance between the X-ray source and the elliptic monochromator can be smaller in the invention, the capture angle $\alpha$ of incident X-rays on the elliptic monochromator is increased, for example, the capture solid angle may be more than 0.0005 steradian, so that the X-ray intensity on the second focal point can be greatly increased than before.

The advantage of the present invention will now be described in detail. It will be understood from the below description that a higher X-ray intensity is obtained on the sample by using, in case of being combined with the composite monochromator, not the normal-focus or the fine-focus X-ray sources but the microfocus X-ray source which has a very small X-ray power as compared with the normal-focus or the fine-focus X-ray sources. That is to say, we have discovered a combination of the microfocus X-ray source with a very high brightness and the composite elliptic monochromator so arranged that it can take a large capture angle.

Considering the condition that divergent X-rays are effectively focused by the focusing composite elliptic monochromator, a capture solid angle $\Omega$ for incident X-rays on the composite elliptic monochromator is expressed by $$\Omega=\alpha^2=A/S^2 \tag{5}$$

where $\alpha$ is the divergence angle of incident X-rays on the composite monochromator, A is the apparent area of the composite monochromator, and S is the distance between the focal spot of the X-ray source and the composite monochromator. The X-ray intensity I on a sample is expressed by $$I=\eta P\Omega \tag{6}$$

where $\eta$ is the optical efficiency of the focusing composite monochromator for the X-ray intensity I on the sample, and P is the power (i.e., the effective total dose) of the X-ray source.

The focal spot size D of the X-ray source is expressed by $$D\approx S\cdot\Delta\theta \tag{7}$$

where $\Delta\theta$ is the breadth of the incidence angle of X-rays, noting that the breadth $\Delta\theta$ in this equation should be equal to the half-value width $\epsilon$ of the diffraction peak observed with the composite monochromator so that incident X-rays within the breadth $\Delta\theta$ can be effectively reflected by the composite monochromator. The brightness B (i.e., the X-ray power per unit area) of the X-ray source is expressed by $$B=P/D^2. \tag{8}$$

Accordingly, $$I=\eta P\Omega=\eta PA/S^2=\eta BA\cdot\Delta\theta^2. \tag{9}$$

Therefore, if the same composite monochromator is used, $\eta$, A, and $\Delta\theta$ become constant, and the X-ray intensity I becomes essentially proportional to the brightness B of the X-rays.

On the other hand, the possible brightness B of the X-ray source depends on both thermal limitation and electronic limitation. When the focal spot size of the X-ray source becomes very small, the electronic limitation becomes dominant. On the contrary, if the focal spot size of the X-ray source becomes not so small, the thermal limitation is dominant. The practical microfocus X-ray source in the art would have a possible minimum focal spot size of down to about 1 to 2 micrometers, with the technical improvement, in the case of using both the electronic gun and the electromagnetic lens. The electronic limitation would be dominant for the focal spot size of less than about 2 micrometers. Accordingly, for the focal spot size of more than about 2 micrometers, only the thermal limitation may be taken in account for defining the relationship between the focal spot size and the brightness of the X-ray source.

The allowable input power P' of an X-ray source can be calculated in general by Muller's equation, the allowable power P' depending upon the material, shape and thermal condition of the X-ray target. The possible output power P (i.e., the X-ray intensity) of the X-ray source would be proportional to the allowable input power P' in the same condition. The allowable input power P' can be calculated by $$P'\approx 4.25\kappa T_m W/2 \tag{10}$$

where $\kappa$ is the thermal conductivity of the target material, $T_m$ is the temperature difference between the allowable maximum temperature of the focal spot surface and the cooled surface of the target, and W is the length of one side of a square focal spot on which an electron beam impinges at right angles. Assuming that the target material is copper and the shape of the focal spot on the target is a point focus, the allowable input power P' for the focal spot size is shown in Table 1.

TABLE 1

| | Focal Spot Size | P' (W) | B' (W/mm$^2$) |
|---|---|---|---|
| Normal Focus | 1 mm × 1 mm | 750 | 750 |
| Fine Focus | 0.1 mm × 0.1 mm | 75 | 7500 |
| Microfocus | 0.01 mm × 0.01 mm | 7.5 | 75000 |

In Table 1, B' is the brightness which is observed in a direction perpendicular to the target surface of the X-ray source, the value of B' being obtained by dividing P' by the incident-electron-beam spot area which is substantially equal to the focal spot area of the X-ray source. The indicated value of B' for each focal spot size has been confirmed experimentally.

The apparent focal spot size D and the apparent brightness B of the X-rays emitted from an X-ray source, even for the same electron-beam spot size W on the target, vary with the take-off angle. As shown in FIG. 2B, even for the line focus on the target, when taking an X-ray beam in the illustrated direction, the resultant X-ray beam is to be emitted from an apparent point focus. For example, assuming that the line focus on the target shown in FIG. 2B has a size of $W_1$=0.01 mm and $W_2$=0.1 mm, i.e., the microfocus line focus, we can obtain a microfocus X-ray beam emitted from an apparent point focus with an apparent focal spot size of $D_1=W_1$=0.01 mm and $D_2=W_2\sin(6 \text{ degrees})$=0.01 mm when taking X-rays in the illustrated direction. The allowable input power P' for the apparent point focus with the take-off angle of 6 degrees is shown in Table 2.

TABLE 2

| | Focal Spot Size | P' (W) | B (W/mm$^2$) |
|---|---|---|---|
| Normal Focus | 1 mm × 1 mm | 3180 | 3180 |
| Fine Focus | 0.1 mm × 0.1 mm | 318 | 31800 |
| Microfocus | 0.01 mm × 0.01 mm | 31.8 | 318000 |

In Table 2, B is the brightness which is observed in the direction of the take-off angle of about 6 degrees, the value of B being obtained, as an approximate value, by dividing P' by the apparent focal spot area.

The normal-focus X-ray source typically has an allowable input power $P_a$ of about 3 kW and a brightness B of about 3000 W/mm$^2$, while the microfocus X-ray source has, although depending on the focus shape, an allowable input power P' of about 30 W as shown in Table 2, which has been obtained experimentally as an approximate value, and a brightness B of about 300 kW/mm$^2$ which is 100 times higher than that in the normal-focus.

As the focal spot size decreases, within the range of down to about 2 micrometers, the brightness B increases and accordingly the X-ray intensity I on the sample also increases as indicated in the equation (9). It is noted therefore that a combination of the composite elliptic monochromator and the microfocus X-ray source having a very small power leads to a greatly increased X-ray intensity on the sample as compared with the prior art.

The apparent focal spot size of an X-ray source is defined by the maximum span across the focal spot image as viewed from the elliptic monochromator. The present invention is effective in the case of the apparent focal spot size of less than 30 micrometers, and preferably within the range of 2 to 20 micrometers, and typically about 10 micrometers.

With the present invention, the minimum distance between the focal spot of an X-ray target and the composite monochromator can be less than 50 mm, and preferably less than 30 mm, and more preferably about 10 to 20 mm. It is noted that the lower limit value of the minimum distance would depend upon, in general, structural restrictions of the X-ray tube.

The elliptic monochromator used in this invention has an extremely compressed shape, so that an X-ray source, which is to be located on the focal point of the ellipse, can be close to the elliptic monochromator.

The main feature of the apparatus for X-ray analysis of the invention is directed to the X-ray supplying system which is arranged between an X-ray source and a sample, so that an optical system between the sample and a detector has no restrictions in the invention. For example, when X-rays emitted from the microfocus X-ray source are focused by the composite monochromator on a sample and the diffracted X-rays from the sample are detected, such apparatus for X-ray analysis according to the invention becomes an X-ray diffraction system. On the other hand, when the fluorescence X-rays from the sample are detected, such apparatus for X-ray analysis according to the invention becomes a fluorescence X-ray analysis system.

DETAILED DESCRIPTION OF THE PREFERRED EMBODIMENTS

Figure 1:
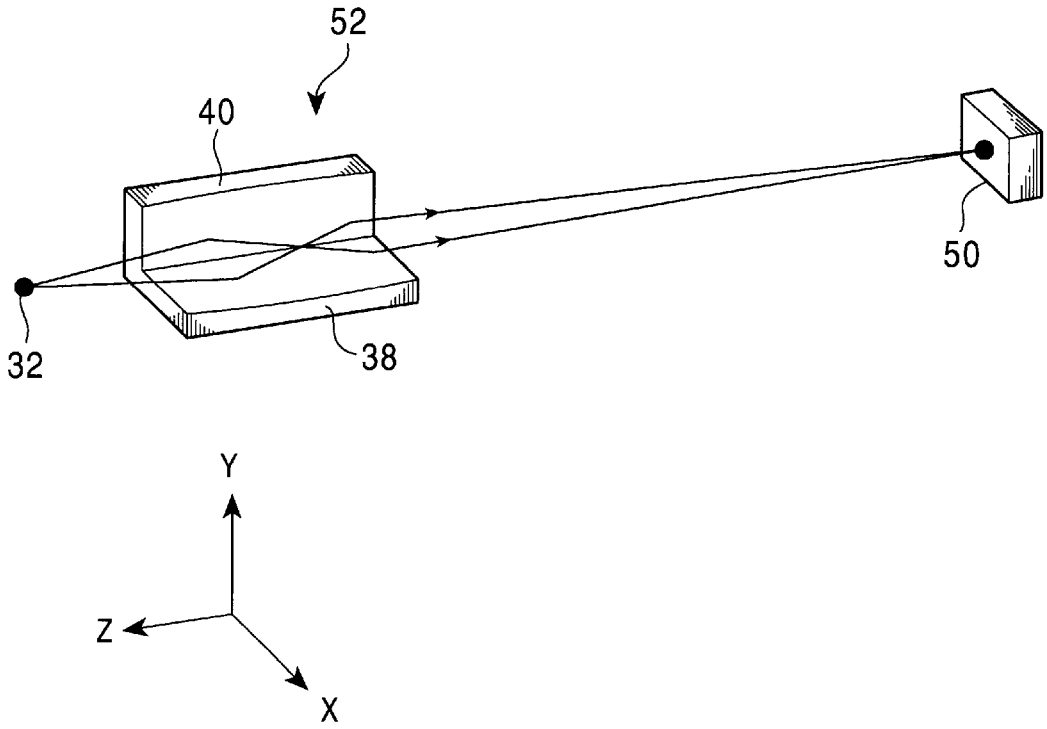
FIG. 1 is a perspective view of the first embodiment of the invention.

Referring to FIG. 1 showing the first embodiment of the invention, a side-by-side composite monochromator 52 is arranged between an X-ray source 32 and a sample 50. The composite monochromator 52 has a first elliptic monochromator 38 and a second elliptic monochromator 40, the both monochromators being so connected that one side of the first monochromator is in contact with one side of the second monochromator. The basic structure of the elliptic monochromator 52 is the same as one shown in FIG. 8B. The first elliptic monochromator 38 has focal axes parallel to the X-axis, while the second elliptic monochromator 40 has focal axes parallel to the Y-axis.

Figure 2A:
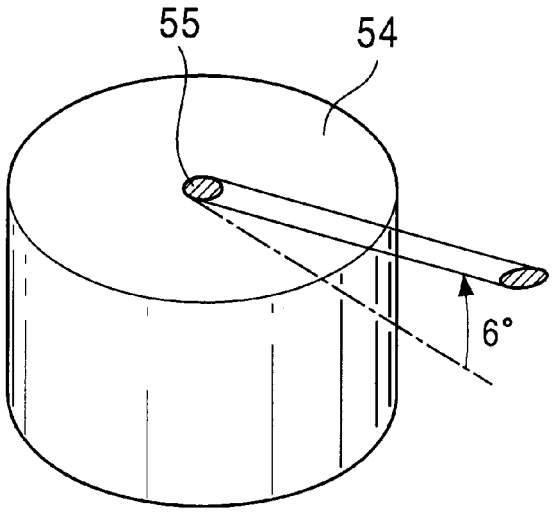
FIGS. 2A and 2B are perspective views of microfocus X-ray sources.
Figure 2B:
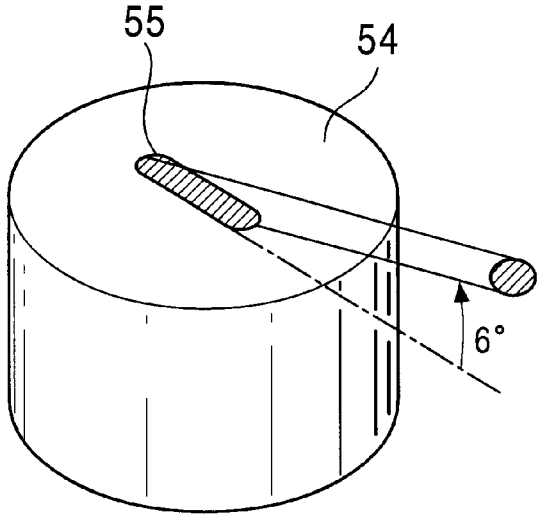

The apparent focal spot size D of the X-ray source 32 is 10 micrometers. To obtain the 10-micrometer apparent focal spot size, it is possible as shown in FIG. 2A to form the focal spot 55, whose spot size is 10 micrometers in diameter, on the target 54 of the X-ray tube and to take X-rays with an appropriate take-off angle, for example, 6 degrees. Alternately, it is also possible as shown in FIG. 2B to form the focal spot 55, which has a linear shape of 10 micrometers in width, on the target 54 of the X-ray tube and to take X-rays in the longitudinal direction of the focal spot 55, i.e., the point-take-off from the line focus. Also in the latter method, we can obtain an apparent focal spot size of 10 micrometers. The X-ray tube used in this embodiment has a target whose material is copper and its characteristic X-rays (i.e., CuKα with the wavelength of 0.154 nanometers) are utilized. It is not necessary in the invention to increase the power of the X-ray tube because the focusing efficiency for X-rays are very good, the power being about 7 Watts with the stationary-anode X-ray tube in the embodiment.

Figure 3:
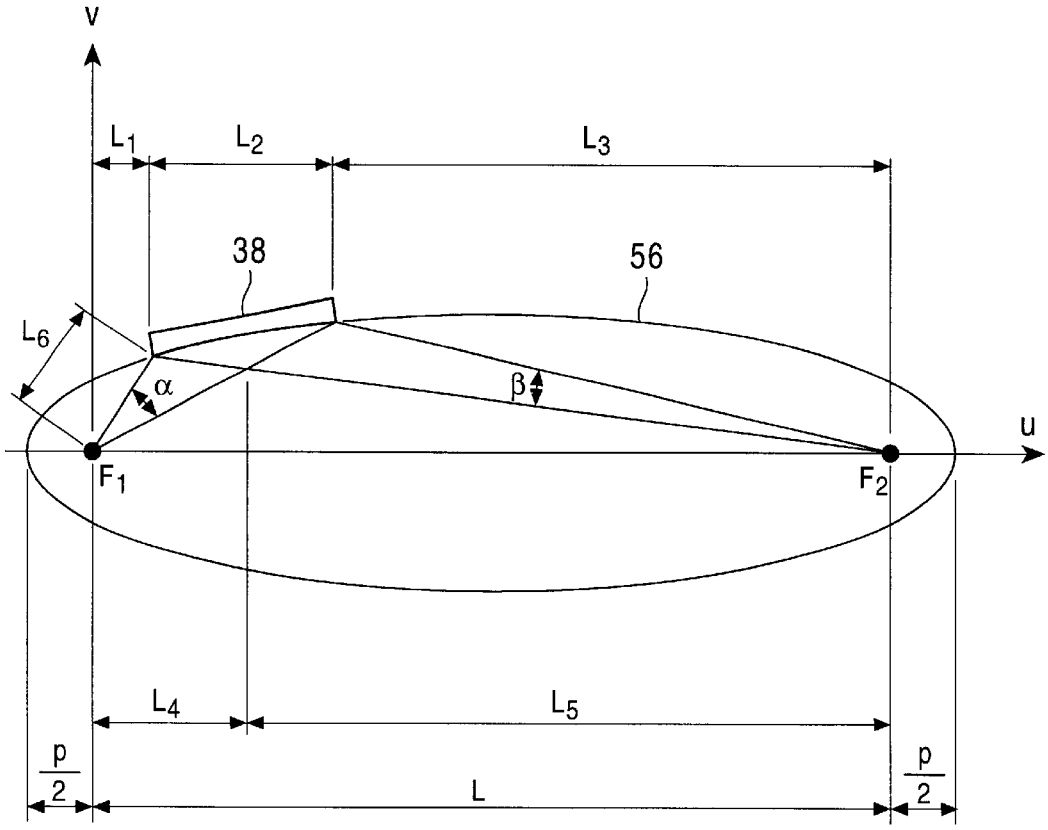
FIG. 3 illustrates the elliptic shape of an elliptic monochromator.

There will now be described a concrete shape of the elliptic-arc of the elliptic monochromator. As shown in FIG. 3, the distance L between the two foci $F_1$ and $F_2$ is 300 mm. Defining the minimum distance between the focal point $F_1$ and the ellipse 56 as p/2, the value of p is 0.03 mm. Accordingly, L is 10-thousand times p and therefore the ellipse 56 is extremely compressed. The other elliptic monochromator 40 has the same shape.

Referring to FIG. 3 which is seen in the X-direction, an X-ray source is positioned at the focal point $F_1$, while a sample is to be set at the focal point $F_2$ (or near that point in the direction of the optical axis). Defining the direction of the line which passes through the foci $F_1$ and $F_2$ as the u-direction and the direction perpendicular thereto as the v-direction, the distance $L_1$ in the u-direction between the focal point $F_1$ and the elliptic monochromator 38 is 15 mm. The size $L_2$ in the u-direction of the elliptic monochromator 38 is 40 mm. The distance $L_3$ in the u-direction between the elliptic monochromator 38 and the focal point $F_2$ is 245 mm. The distance $L_4$ the u-direction between the focal point $F_1$ and the center of the elliptic monochromator 38 is 35 mm, and the distance $L_5$ in the u-direction between the focal point $F_2$ and the center of the elliptic monochromator 38 is 265 mm. $L_1+L_2+L_3=L_4+L_5=L=300$ mm.

Table 3 indicates numerically the relationship between the coordinates of the elliptic-arc of the elliptic monochromator 38 and the graded-spacing. The coordinates u and v (the unit is mm) of the elliptic-arc are so measured that the origin of the coordinates is positioned at the focal point $F_1$. The incidence angle θ (the unit is degree) of X-rays is so measured that the X-ray source is positioned at the focal point $F_1$. The unit of the d-spacing is nanometer.

TABLE 3

| u (mm) | v (mm) | θ (degree) | d (nm) |
|---|---|---|---|
| 15 | 0.9251 | 1.8575 | 2.3783 |
| 20 | 1.0587 | 1.6233 | 2.7213 |
| 25 | 1.1729 | 1.4652 | 3.0148 |
| 30 | 1.2731 | 1.3500 | 3.2721 |
| 35 | 1.3622 | 1.2617 | 3.5011 |
| 40 | 1.4424 | 1.1915 | 3.7072 |
| 45 | 1.5151 | 1.1344 | 3.8939 |
| 50 | 1.5813 | 1.0869 | 4.0640 |
| 55 | 1.6418 | 1.0469 | 4.2194 |

It is understood from Table 3 that both the incidence angle θ and the d-spacing vary continuously along the elliptic-arc. The closest point, on the elliptic monochromator 38, to the focal point $F_1$ has the coordinates of u=15 mm and v=0.9251 mm. The distance $L_6$ between the closest point and the focal point F1 is calculated by $L_6=(u^2+v^2)^{1/2}=15.03$ mm. On the closest point, the breadth Δθ of the incidence angle is calculated with the equation (4) by $\Delta\theta=D/L_6=0.01/15.03=0.00067$ radian. This value of Δθ is less than the half-value width ϵ=0.001 of the monochromator having the synthetic multilayered thin film. At any point farther apart from the focal point F1 than the closest point, the breadth Δθ of the incidence angle becomes less than the above value, so we have no problem. Accordingly, all of the X-rays, with the wavelength of interest, impinging on the elliptic monochromator are to be reflected effectively.

Next, there will be described the capture of X-rays by the composite monochromator. The divergence angle α of X-rays which are incident on the elliptic monochromator indicated in Table. 3 is 1.82 degrees as calculated below. The convergence angle β of X-rays is 0.15 degrees. The above value of the divergence angle α can be converted from the degree unit to the radian unit, i.e., 0.0318 radian. The first elliptic monochromator catches in the YZ-plane the divergence angle $\alpha_y=0.0318$ radian, while the second elliptic monochromator catches in the ZX-plane the divergence angle $\alpha_x=0.0318$ radian. The solid angle Ω of X-rays which are caught by the composite monochromator is $\Omega=\alpha_x\alpha_y=0.001$ steradian.

With the composite monochromator, when the apparent focal spot size D of the X-ray source is 0.01 mm, the spot size of X-rays focused on the sample is 0.2 mm. The sample may be set at the second focal point of the elliptic monochromator (the standard point) or at any necessary point before or behind, on the optical axis, the standard point, depending upon the measuring conditions (i.e., sample size, required intensity, etc.).

The synthetic multilayered thin film with the graded d-spacing as shown in Table 3 can be produced popularly by depositing alternating layers of high atomic number, for example, tungsten (W), and low atomic number, for example, silicon(Si), materials. Another combination may be tungsten (W) and boron carbide ($B_4C$). The period of the layers is equal to the d-spacing. The thickness ratio of the two kinds of the layers may be selected variously.

As seen from Table 3, the incidence angle θ of X-rays on the elliptic monochromator is small as about 1 to 2 degrees, and the d-spacing of the synthetic multilayered thin film is about 2 to 4 nanometers.

There will now be described a method of calculating the divergence angle α of X-rays which are incident on the elliptic monochromator. Referring to FIG. 3, the coordinates (u, v) of the elliptic-arc of the monochromator 38 satisfy the following equation (11) which is derived from the equation for ellipse:

$$v=f(u)=[\{p(2L+p)\ (-u^2+Lu+p(2L+p)/4)\}/(L+p)^2]^{1/2}. \quad (11)$$

Assuming that L1=G and L1+L2=H, the divergence angle α can be calculated by the following equation (12), in which the above equation (11) should be used for the function f:

$$\alpha=\cos^{-1}[(GH+f(G)f(H))/\{(G^2+f(G)^2)^{1/2}(H^2+f(H)^2)^{1/2}\}]. \quad (12)$$

Figure 4:
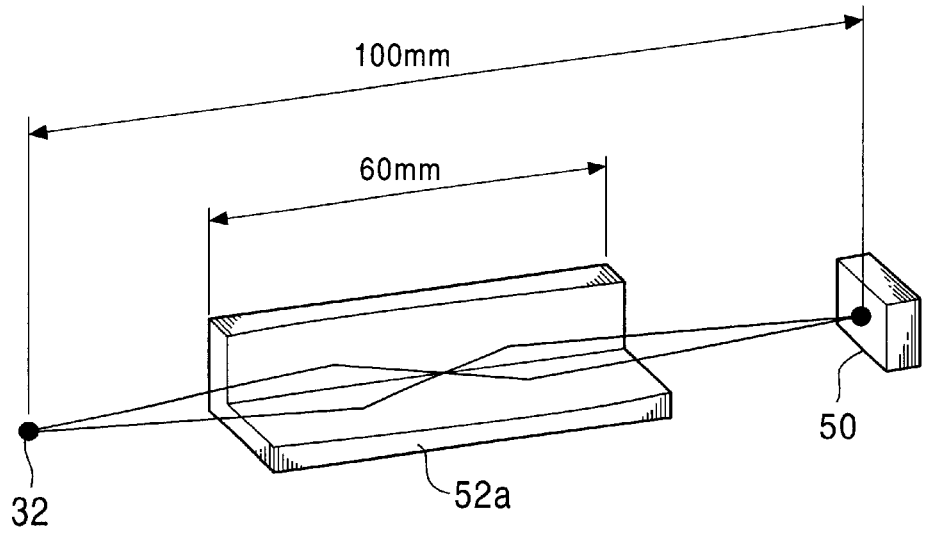
FIG. 4 is a perspective view of the second embodiment of the invention.
Figure 5:
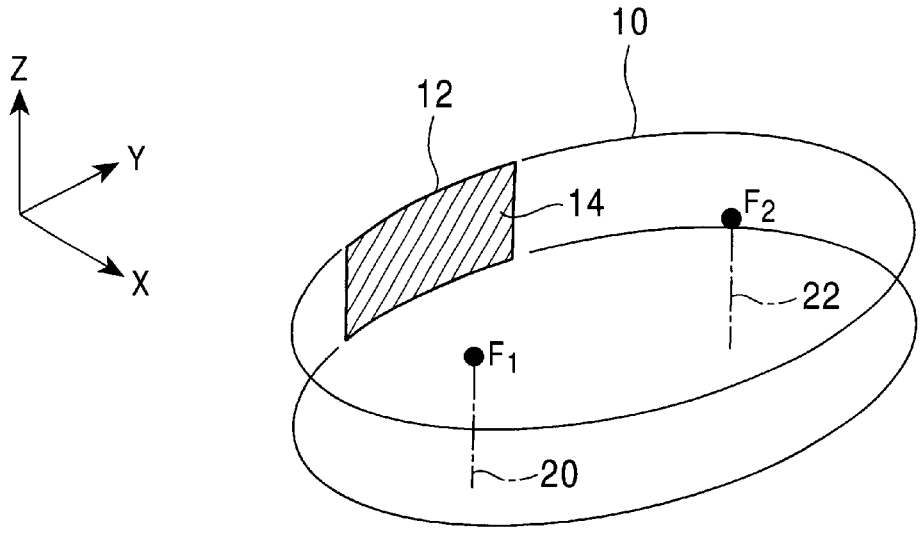
FIG. 5 is a perspective view illustrating the definition of the elliptic monochromator.
Figure 6:
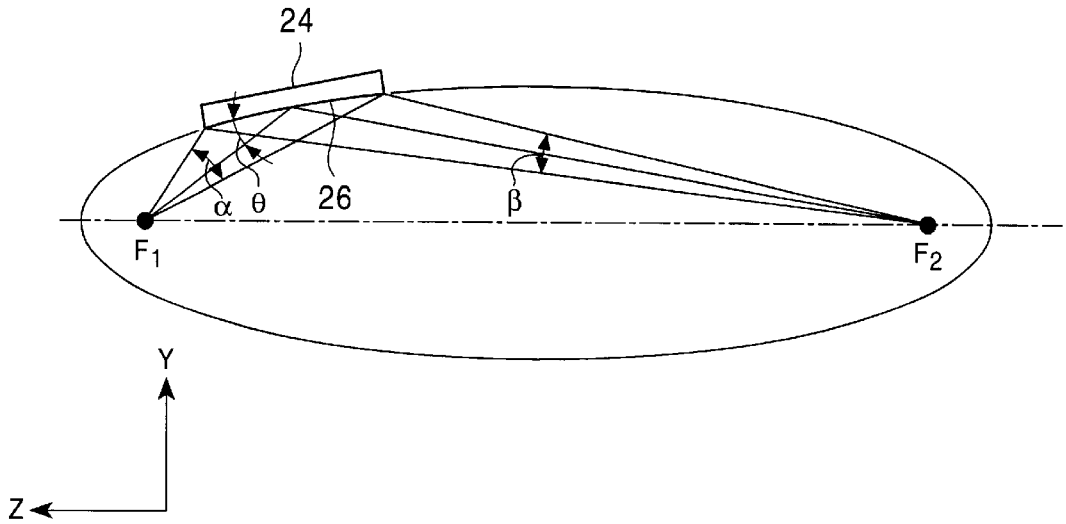
FIG. 6 is a side view illustrating the function of the elliptic monochromator.
Figure 7:
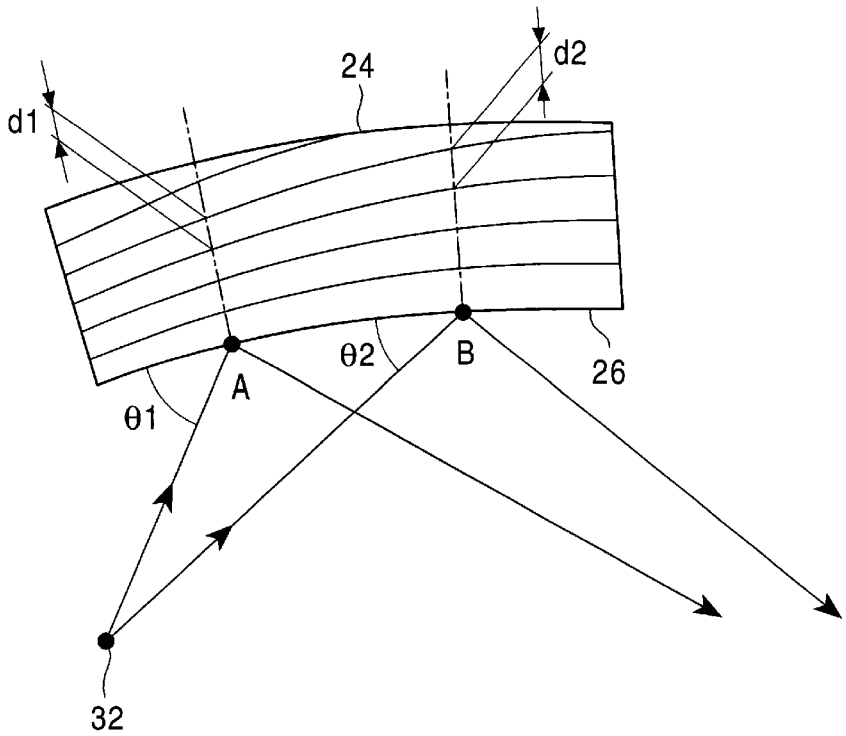
FIG. 7 illustrates the functional principle of the monochromator with graded d-spacing.

There will now be described the second embodiment of the invention with reference to FIG. 4. Although the basic structure of the second embodiment is the same as that of the first embodiment shown in FIG. 1., the design values of the elliptic monochromator are different. In the second embodiment, the length of the composite monochromator 52*a* is 60 mm, and the distance between an X-ray source 32 (located on the first focal point) and a sample 50 (located on the second focal point) is 100 mm. The distance between the composite monochromator 52*a* and the sample 50 is smaller than that of the first embodiment, so that the X-ray spot size on the sample becomes small down to 0.047 mm in case of the same X-ray source as in the first embodiment. Namely, it is possible with the second embodiment to carry out X-ray analysis for very small samples.

Explaining the elliptic shape of the second embodiment with the use of the symbols shown in FIG. 3, p=0.022 mm, L=100 mm, $L_1$=17 mm, $L_2$=60 mm, $L_3$=23 mm, $L_4$=47 mm, and $L_5$=53 mm. In this case, L is 4545 times p. Table 4 indicates numerically the second embodiment, the meaning of the symbols being the same as in Table 3.

TABLE 4

| u (mm) | v (mm) | θ (degree) | d (nm) |
|---|---|---|---|
| 17 | 0.78811 | 1.5992 | 2.7624 |
| 22 | 0.86907 | 1.4503 | 3.0459 |
| 27 | 0.93136 | 1.3533 | 3.2641 |
| 32 | 0.97857 | 1.2880 | 3.4295 |
| 37 | 1.01281 | 1.2445 | 3.5494 |
| 42 | 1.03536 | 1.2174 | 3.6284 |
| 47 | 1.04698 | 1.2039 | 3.6691 |
| 52 | 1.04803 | 1.2027 | 3.6728 |
| 57 | 1.03854 | 1.2137 | 3.6396 |
| 62 | 1.01822 | 1.2379 | 3.5684 |
| 67 | 0.98641 | 1.2778 | 3.4570 |
| 72 | 0.94193 | 1.3381 | 3.3011 |
| 77 | 0.88287 | 1.4276 | 3.0943 |

In the second embodiment, the divergence angle α of X-rays which are incident on the elliptic monochromator is 2.0 degrees and the convergence angle β of X-rays which are focused on the second focal point is 1.6 degrees.

There will next be described the third embodiment. In the third embodiment, using the symbols shown in FIG. 3, p=0.065 mm, L=400 mm, $L_1$=40 mm, $L_2$=60 mm, $L_3$=300 mm, $L_4$=70 mm, and $L_5$=330 mm. The spot size of the focused X-rays on the second focal point is 0.2 to 0.25 mm. Table 5 indicates numerically the third embodiment, the meaning of the symbols being the same as in Table 3.

TABLE 5

| u (mm) | v (mm) | θ (degree) | d (nm) |
|---|---|---|---|
| 40 | 2.1640 | 1.7206 | 2.5675 |
| 44 | 2.2569 | 1.6498 | 2.6776 |
| 48 | 2.3440 | 1.5886 | 2.7808 |
| 52 | 2.4257 | 1.5351 | 2.8777 |
| 56 | 2.5027 | 1.4879 | 2.9690 |
| 60 | 2.5754 | 1.4459 | 3.0551 |
| 64 | 2.6441 | 1.4083 | 3.1366 |
| 68 | 2.7092 | 1.3745 | 3.2138 |
| 72 | 2.7708 | 1.3439 | 3.2869 |
| 76 | 2.8293 | 1.3162 | 3.3562 |
| 80 | 2.8848 | 1.2909 | 3.4220 |
| 84 | 2.9375 | 1.2677 | 3.4845 |
| 88 | 2.9875 | 1.2465 | 3.5437 |
| 92 | 3.0350 | 1.2270 | 3.6000 |
| 96 | 3.0801 | 1.2091 | 3.6535 |
| 100 | 3.1228 | 1.1925 | 3.7041 |

In the third embodiment, the divergence angle α of X-rays which are incident on the elliptic monochromator is 1.31 degrees, which is equal to 0.0229 radian. The first elliptic monochromator catches in the YZ-plane the divergence angle $\alpha_y$=0.0229 radian, while the second elliptic monochromator catches in the ZX-plane the divergence angle $\alpha_x$=0.0229 radian. The solid angle Ω of X-rays which are caught by the composite monochromator is $\Omega=\alpha_x\alpha_y=0.00052$ steradian.

Figure 13:
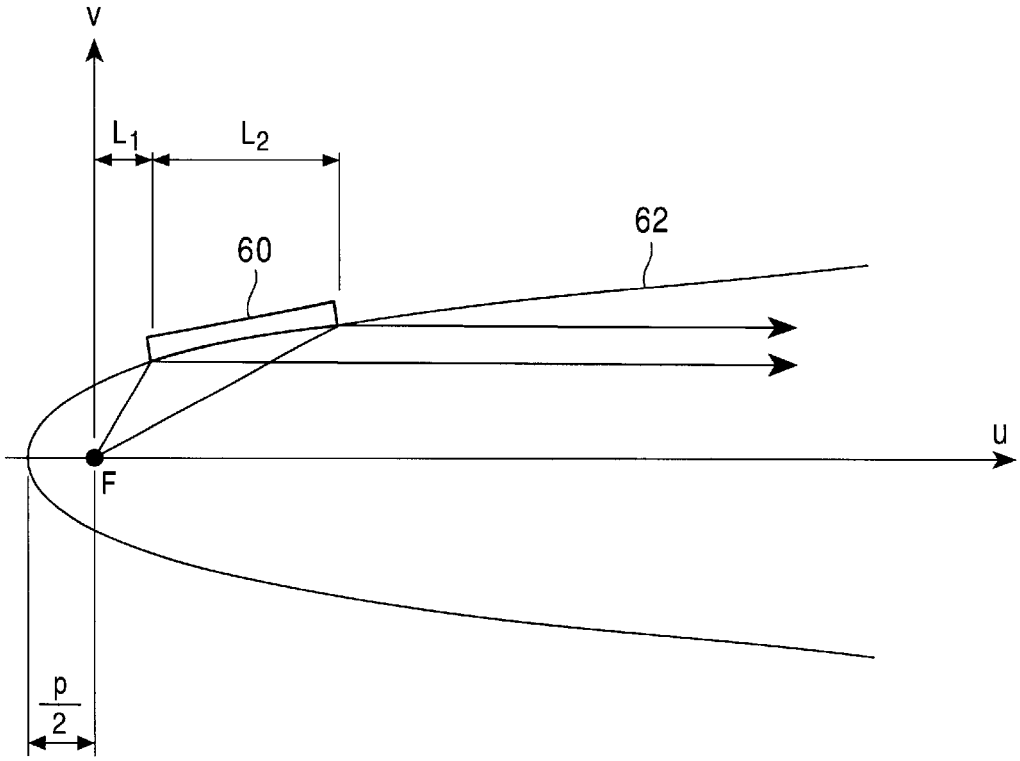
FIG. 13 illustrates the parabolic shape of a parabolic monochromator.

Although the elliptic monochromator has been described above, the elliptic monochromator may be altered to a parabolic monochromator. There will now be described another embodiment in which the present invention is applied to the parabolic monochromator. Referring to FIG. 13 illustrating the parabolic shape of the parabolic monochromator, a parabola 62 which defines a parabolic monochromator 60 has one focal point. Defining the minimum distance between the focal point F and the parabola 62 as p/2, the value of p is 0.026 mm. A microfocus X-ray source is positioned at the focal point F. The X-rays reflected by the monochromator become parallel X-rays, so that the intensity of X-rays impinging on a sample is constant even if the sample is set at any position on the optical axis. Defining the u-direction and the v-direction as illustrated in FIG. 13, the distance $L_1$ in the u-direction between the focal point F and the parabolic monochromator 60 is 15 mm. The size $L_2$ in the u-direction of the parabolic monochromator 60 is 40 mm. Two parabolic monochromators of such a shape are combined as shown in FIG. 1 to form a composite monochromator. The apparent focal spot size of the used X-ray source is 10 micrometers, and the X-ray spot size on a sample is 0.8 mm in diameter.

Table 6 indicates numerically the relationship between the coordinates of the parabolic-arc of the parabolic monochromator 60 and the graded d-spacing. The coordinates u and v (the unit is mm) are so measured that the origin of the coordinates is positioned at the focal point F. The incidence angle θ (the unit is degree) of X-rays is so measured that the X-ray source is positioned at the focal point F. The unit of the d-spacing is nanometer.

TABLE 6

| u (mm) | v (mm) | θ (degree) | d (nm) |
|---|---|---|---|
| 15 | 0.8836 | 1.6855 | 2.6209 |
| 20 | 1.0201 | 1.4600 | 3.0257 |
| 25 | 1.1405 | 1.3060 | 3.3824 |
| 30 | 1.2493 | 1.1923 | 3.7049 |
| 35 | 1.3493 | 1.1039 | 4.0015 |
| 40 | 1.4425 | 1.0326 | 4.2776 |
| 45 | 1.5299 | 0.9736 | 4.5369 |
| 50 | 1.6123 | 0.9237 | 4.7822 |
| 55 | 1.6914 | 0.8807 | 5.0155 |

Figure 8A:
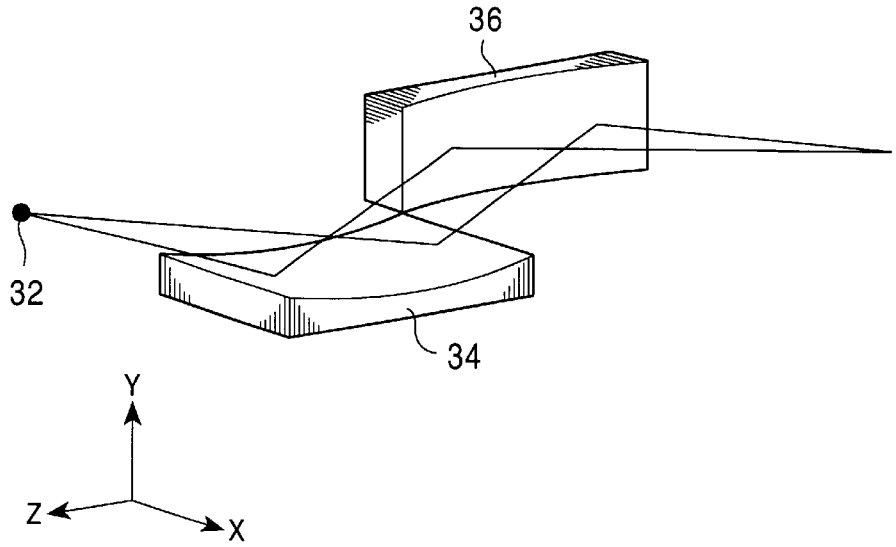
FIGS. 8A and 8B are perspective views of the sequential-arrangement and the side-by-side arrangement elliptic monochromators.
Figure 8B:
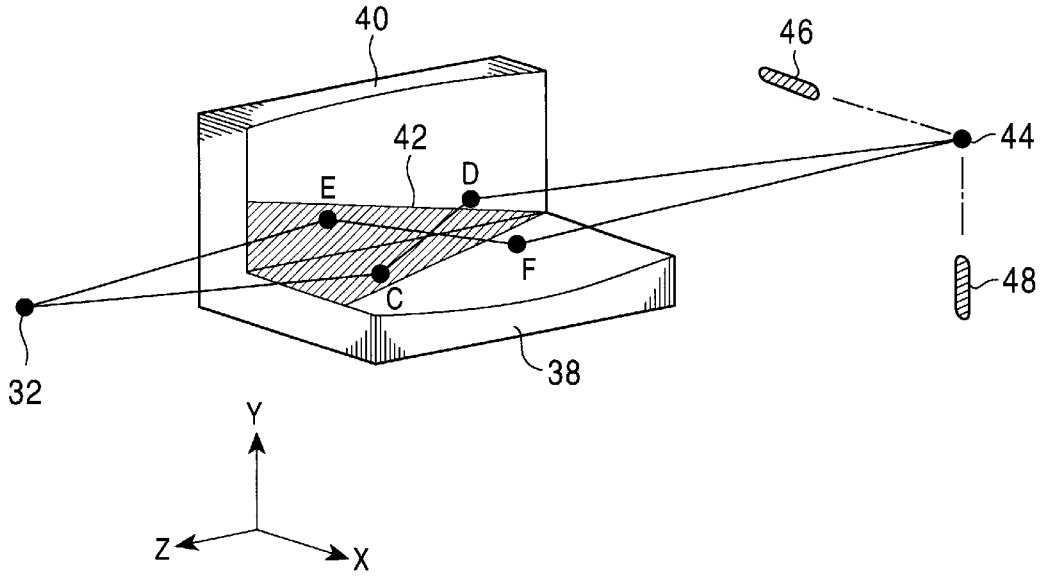
Figure 9A:
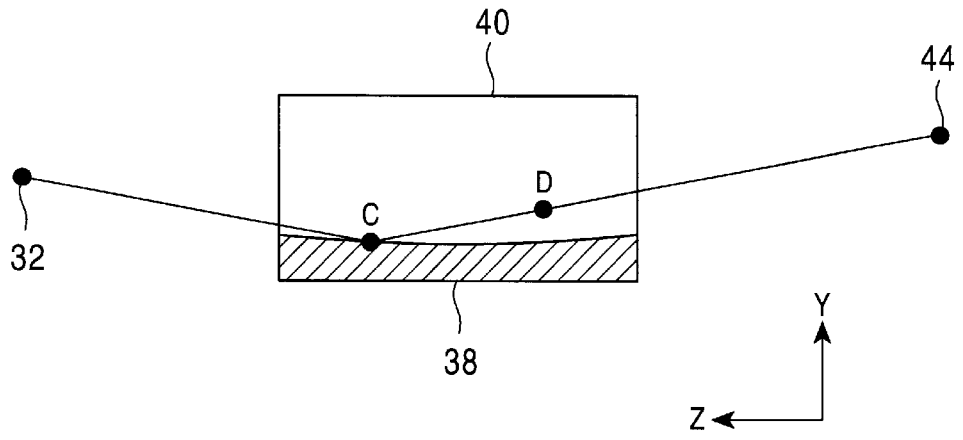
FIGS. 9A and 9B are views seen in the X-direction and the Y-direction which illustrate one reflection on the side-by-side elliptic monochromator.
Figure 9B:
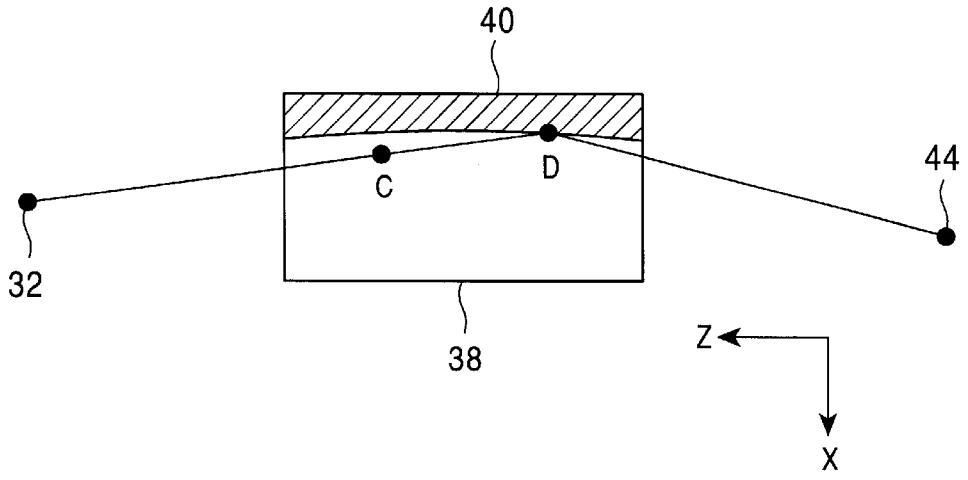
Figure 10A:
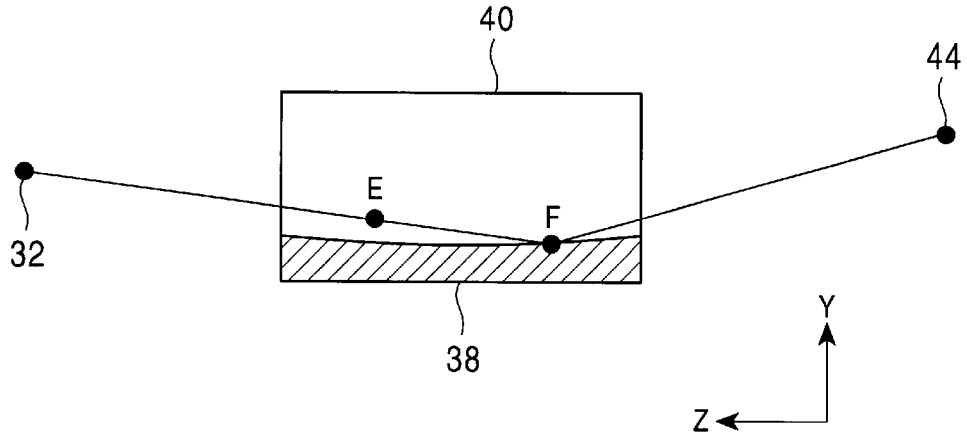
FIGS. 10A and 10B are views seen in the X-direction and the Y-direction which illustrate the other reflection on the side-by-side elliptic monochromator.
Figure 10B:
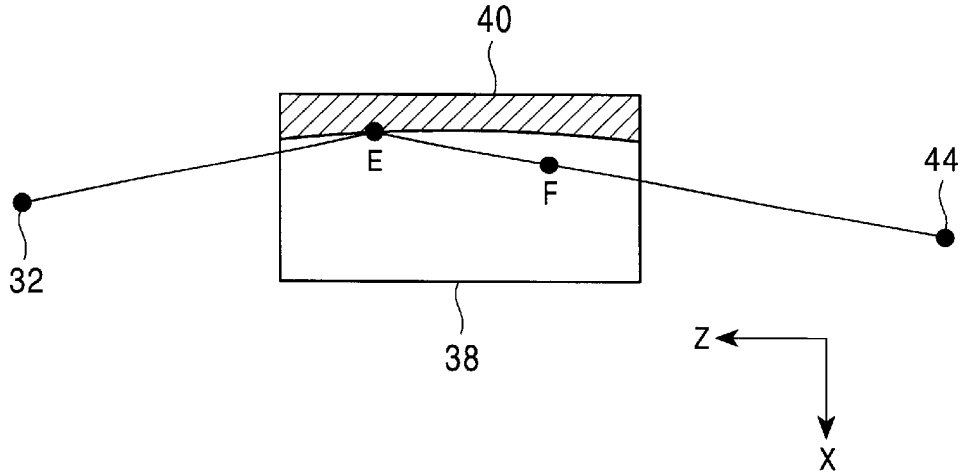
Figure 11:
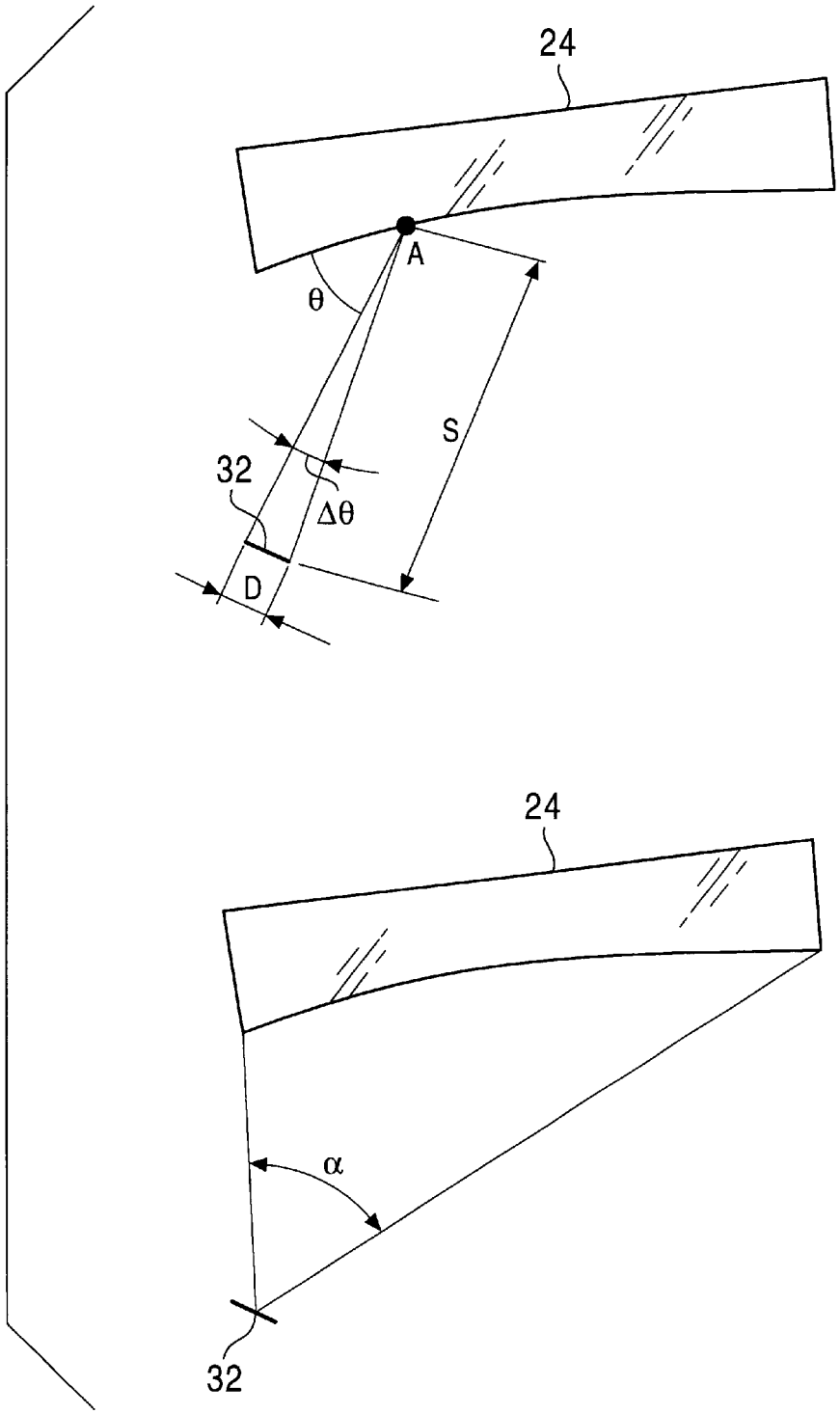
FIG. 11 is a side view illustrating an effect of the focal spot size of an X-ray source.
Figure 12:
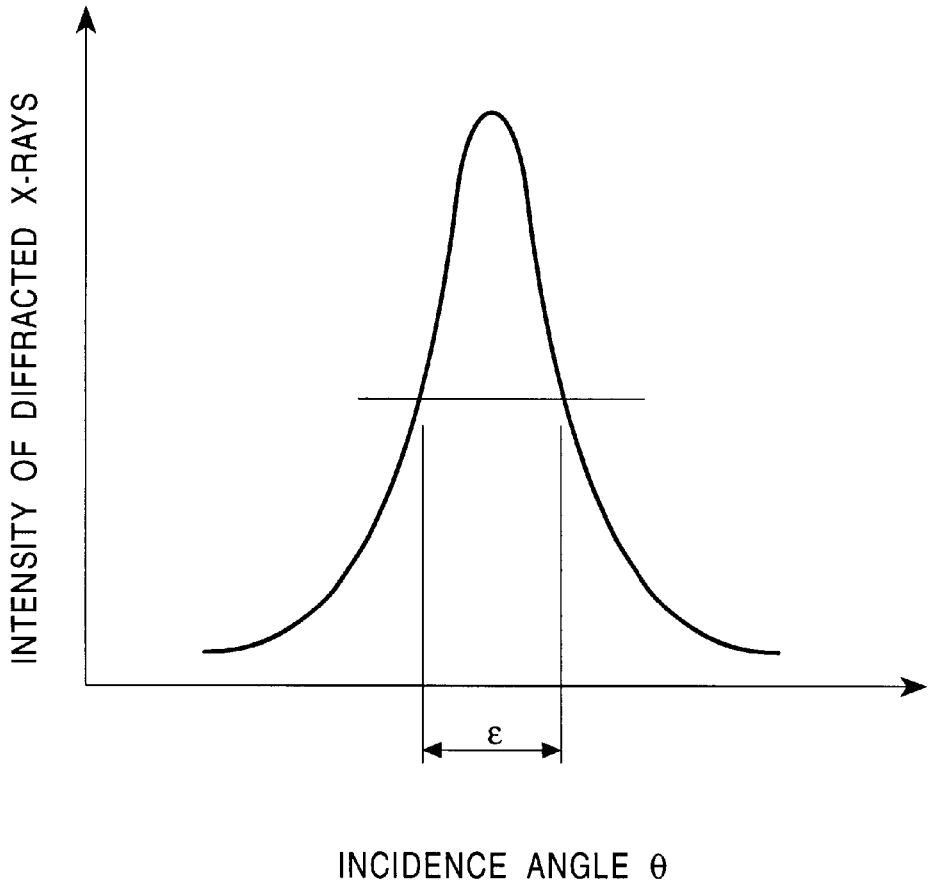
FIG. 12 a graph showing the diffracted peak obtained with a synthetic multilayered thin film.

It should be noted in the invention that the first and second monochromators may be partly translated in the direction shown in FIG. 8A without departing from the spirit of the invention (depending upon the focal spot size of the microfocus X-ray source, the minimum distance between the focal spot of the X-ray source and the monochromator, the solid angle which is caught by the monochromator, etc.). In such a case, the intensity distribution of X-rays reflected by the composite monochromator might be deformed, because the capture solid angle in the YZ-plane is different from that in the ZX-plane. However, it would be possible for the partly-translated composite monochromator to effect the similar advantage to the non-translated composite monochromator as shown in FIG. 8B, depending upon the measurement condition (the size and the position of the sample, the required X-ray intensity, etc.).

What is claimed is:

1. An apparatus for X-ray analysis in which X-rays emitted from an X-ray source are reflected by a monochromator and are to be incident on a sample, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y-direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) a minimum distance between a focal spot of said X-ray source and said composite monochromator is less than 50 mm.

2. An apparatus for X-ray analysis according to claim 1, wherein the minimum distance between the focal spot of said X-ray source and said composite monochromator is less than 30 mm.

3. An apparatus for X-ray analysis according to claim 2, wherein said apparent focal spot size is 2 to 20 micrometers.

4. An apparatus for X-ray analysis according to claim 1, wherein said apparent focal spot size is 2 to 20 micrometers.

5. An apparatus for X-ray analysis in which X-rays emitted from an X-ray source are reflected by a monochromator and are to be incident on a sample, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y-direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) a solid angle of X-rays which are caught by said composite monochromator is more than 0.0005 steradian.

6. An apparatus for X-ray analysis according to claim 5, wherein said apparent focal spot size is 2 to 20 micrometers.

7. An apparatus for X-ray analysis in which X-rays emitted from an X-ray source are reflected by a monochromator and are to be incident on a sample, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y- direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) each of an ellipse defining said first elliptic monochromator and an ellipse defining said second elliptic monochromator has a compressed shape so that a distance L between the two focal points of each said ellipse is 4000 to 10000 times p, with p being a minimum distance between each said ellipse and one of the focal points of each said ellipse.

8. An apparatus for X-ray analysis according to claim 7, wherein said apparent focal spot size is 2 to 20 micrometers.

9. An apparatus for X-ray analysis in which X-rays emitted from an X-ray source are reflected by a monochromator and are to be incident on a sample, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) a solid angle of X-rays which are emitted from said X-ray source and caught by said composite monochromator is more than 0.0005 steradian.

10. An apparatus for X-ray analysis according to claim 9, wherein said sample is located at or near, in a direction of an optical axis, a second focal point of said first elliptic monochromator, and said sample is located at or near, in a direction of an optical axis, a second focal point of said second elliptic monochromator.

11. An apparatus for X-ray analysis in which X-rays emitted from an X-ray source are reflected by a monochromator and are to be incident on a sample, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) a minimum distance between a focal spot of said X-ray source and said composite monochromator is less than 50 mm.

12. An apparatus for X-ray analysis according to claim 11, wherein said sample is located at or near, in a direction of an optical axis, a second focal point of said first elliptic monochromator, and said sample is located at or near, in a direction of an optical axis, a second focal point of said second elliptic monochromator.

13. An apparatus for X-ray analysis in which X-rays emitted from an X-ray source are reflected by a monochromator and are to be incident on a sample, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) each of an ellipse defining said first elliptic monochromator and an ellipse defining said second elliptic monochromator has a compressed shape so that a distance L between the two focal points of each said ellipse is 4000 to 10000 times p, with p being a minimum distance between each said ellipse and one of the focal points of each said ellipse.

14. An apparatus for X-ray analysis according to claim 13, wherein said sample is located at or near, in a direction of an optical axis, a second focal point of said first elliptic monochromator, and said sample is located at or near, in a direction of an optical axis, a second focal point of said second elliptic monochromator.

15. An apparatus for supplying X-rays in which X-rays emitted from an X-ray source are reflected by a monochromator, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y-direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) a minimum distance between a focal spot of said X-ray source and said composite monochromator is less than 50 mm.

16. An apparatus for supplying X-rays according to claim 15, wherein said apparent focal spot size is 2 to 20 micrometers.

17. An apparatus for supplying X-rays in which X-rays emitted from an X-ray source are reflected by a monochromator, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y-direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) a solid angle of X-rays which are caught by said composite monochromator is more than 0.0005 steradian.

18. An apparatus for supplying X-rays according to claim 17, wherein said apparent focal spot size is 2 to 20 micrometers.

19. An apparatus for supplying X-rays in which X-rays emitted from an X-ray source are reflected by a monochromator, wherein:

(a) said X-ray source is a microfocus X-ray source having an apparent focal spot size of less than 30 micrometers;

(b) said monochromator is a composite monochromator comprising a first elliptic monochromator and a second elliptic monochromator;

(c) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(d) said first elliptic monochromator has one side which is in contact with one side of said second elliptic monochromator;

(e) said X-ray source is positioned at a first focal point of said first elliptic monochromator as viewed in said X-direction;

(f) said X-ray source is positioned at a first focal point of said second elliptic monochromator as viewed in said Y-direction;

(g) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (h) each of an ellipse defining said first elliptic monochromator and an ellipse defining said second elliptic monochromator has a compressed shape so that a distance L between the two focal points of each said ellipse is 4000 to 10000 times p, with p being a minimum distance between each said ellipse and one of the focal points of each said ellipse.

20. An apparatus for supplying X-rays according to claim 19, wherein said apparent focal spot size is 2 to 20 micrometers.

21. An apparatus for supplying X-rays in which X-rays emitted from an X-ray source are reflected by a monochromator, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) a solid angle of X-rays which are emitted from said X-ray source and caught by said composite monochromator is more than 0.0005 steradian.

22. An apparatus for supplying X-rays in which X-rays emitted from an X-ray source are reflected by a monochromator, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) a minimum distance between a focal spot of said X-ray source and said composite monochromator is less than 50 mm.

23. An apparatus for supplying X-rays in which X-rays emitted from an X-ray source are reflected by a monochromator, wherein:

(a) said monochromator is a composite monochromator comprising a first elliptic monochromator and a second elliptic monochromator;

(b) assuming that a three-dimensional rectangular coordinate axis XYZ is set in space, said first elliptic monochromator has a reflecting surface which is an elliptic-arc surface with focal axes substantially parallel to an X-direction, and said second elliptic monochromator has a reflecting surface which is an elliptic-arc surface with focal axes substantially parallel to a Y-direction;

(c) said first elliptic monochromator has one side which is in contact with one side of said second elliptic monochromator;

(d) said X-ray source is positioned at a first focal point of said first elliptic monochromator as viewed in said X-direction;

(e) said X-ray source is positioned at a first focal point of said second elliptic monochromator as viewed in said Y-direction;

(f) each of said first and second elliptic monochromators comprises a synthetic multilayered thin film whose d-spacing varies continuously along an elliptic-arc so as to satisfy a Bragg equation for X-rays of a predetermined wavelength at any point of said reflecting surface; and (g) each of an ellipse defining said first elliptic monochromator and an ellipse defining said second elliptic monochromator has a compressed shape so that a distance L between the two focal points of each said ellipse is 4000 to 10000 times p, with p being a minimum distance between each said ellipse and one of the focal points of each said ellipse.

24. An apparatus for X-ray analysis in which X-rays emitted from an X-ray source are reflected by a monochromator and are to be incident on a sample, wherein:

(a) said X-ray source is a microfocus X-ray source having an apparent focal spot size of less than 30 micrometers;

(b) said monochromator is a composite monochromator comprising a first parabolic monochromator and a second parabolic monochromator;

(c) assuming that a three-dimensional rectangular coordinate axis XYZ is set in space, said first parabolic monochromator has a reflecting surface which is a parabolic-arc surface with a focal axis substantially parallel to an X-direction, and said second parabolic monochromator has a reflecting surface which is a parabolic-arc surface with a focal axis substantially parallel to a Y-direction;

(d) said first parabolic monochromator has one side which is in contact with one side of said second parabolic monochromator;

(e) said X-ray source is positioned at a focal point of said first parabolic monochromator as viewed in said X-direction;

(f) said X-ray source is positioned at a focal point of said second parabolic monochromator as viewed in said Y-direction;

(g) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (h) a minimum distance between a focal spot of said X-ray source and said composite monochromator is less than 50 mm.

25. An apparatus for X-ray analysis in which X-rays emitted from an X-ray source are reflected by a monochromator and are to be incident on a sample, wherein:

(a) said monochromator is a composite monochromator comprising a first parabolic monochromator and a second parabolic monochromator;

(b) assuming that a three-dimensional rectangular coordinate axis XYZ is set in space, said first parabolic monochromator has a reflecting surface which is a parabolic-arc surface with focal axes substantially parallel to an X-direction, and said second parabolic monochromator has a reflecting surface which is a parabolic-arc surface with focal axes substantially parallel to a Y-direction;

(c) said first parabolic monochromator has one side which is in contact with one side of said second parabolic monochromator;

(d) said X-ray source is positioned at a focal point of said first parabolic monochromator as viewed in said X-direction;

(e) said X-ray source is positioned at a focal point of said second parabolic monochromator as viewed in said Y-direction;

(f) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (g) a solid angle of X-rays which are emitted from said X-ray source and caught by said composite monochromator is more than 0.0005 steradian.

26. An apparatus for X-ray analysis in which X-rays emitted from an X-ray source are reflected by a monochromator and are to be incident on a sample, wherein:

(a) said monochromator is a composite monochromator comprising a first parabolic monochromator and a second parabolic monochromator;

(b) assuming that a three-dimensional rectangular coordinate axis XYZ is set in space, said first parabolic monochromator has a reflecting surface which is a parabolic-arc surface with focal axes substantially parallel to an X-direction, and said second parabolic monochromator has a reflecting surface which is a parabolic-arc surface with focal axes substantially parallel to a Y-direction;

(c) said first parabolic monochromator has one side which is in contact with one side of said second parabolic monochromator;

(d) said X-ray source is positioned at a focal point of said first parabolic monochromator as viewed in said X-direction;

(e) said X-ray source is positioned at a focal point of said second parabolic monochromator as viewed in said Y-direction;

(f) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (g) a minimum distance between a focal spot of said X-ray source and said composite monochromator is less than 50 mm.

27. An apparatus for supplying X-rays in which X-rays emitted from an X-ray source are reflected by a monochromator, wherein:

(a) said X-ray source is a microfocus X-ray source having an apparent focal spot size of less than 30 micrometers;

(b) said monochromator is a composite monochromator comprising a first parabolic monochromator and a second parabolic monochromator;

(c) assuming that a three-dimensional rectangular coordinate axis XYZ is set in space, said first parabolic monochromator has a reflecting surface which is a parabolic-arc surface with a focal axis substantially parallel to an X-direction, and said second parabolic monochromator has a reflecting surface which is a parabolic-arc surface with a focal axis substantially parallel to a Y-direction;

(d) said first parabolic monochromator has one side which is in contact with one side of said second parabolic monochromator;

(e) said X-ray source is positioned at a focal point of said first parabolic monochromator as viewed in said X-direction;

(f) said X-ray source is positioned at a focal point of said second parabolic monochromator as viewed in said Y-direction;

(g) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (h) a minimum distance between a focal spot of said X-ray source and said composite monochromator is less than 50 mm.

28. An apparatus for supplying X-rays in which X-rays emitted from an X-ray source are reflected by a monochromator, wherein:

(a) said monochromator is a composite monochromator comprising a first parabolic monochromator and a second parabolic monochromator;

(b) assuming that a three-dimensional rectangular coordinate axis XYZ is set in space, said first parabolic monochromator has a reflecting surface which is a parabolic-arc surface with focal axes substantially parallel to an X-direction, and said second parabolic monochromator has a reflecting surface which is a parabolic-arc surface with focal axes substantially parallel to a Y-direction;

(c) said first parabolic monochromator has one side which is in contact with one side of said second parabolic monochromator;

(d) said X-ray source is positioned at a focal point of said first parabolic monochromator as viewed in said X-direction;

(e) said X-ray source is positioned at a focal point of said second parabolic monochromator as viewed in said Y-direction;

(f) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (g) a solid angle of X-rays which are emitted from said X-ray source and caught by said composite monochromator is more than 0.0005 steradian.

29. An apparatus for supplying X-rays in which X-rays emitted from an X-ray source are reflected by a monochromator, wherein:

(a) said monochromator is a composite monochromator comprising a first parabolic monochromator and a second parabolic monochromator;

(b) assuming that a three-dimensional rectangular coordinate axis XYZ is set in space, said first parabolic monochromator has a reflecting surface which is a parabolic-arc surface with focal axes substantially parallel to an X-direction, and said second parabolic monochromator has a reflecting surface which is a parabolic-arc surface with focal axes substantially parallel to a Y-direction;

(c) said first parabolic monochromator has one side which is in contact with one side of said second parabolic monochromator;

(d) said X-ray source is positioned at a focal point of said first parabolic monochromator as viewed in said X-direction;

(e) said X-ray source is positioned at a focal point of said second parabolic monochromator as viewed in said Y-direction;

(f) each of said first and second parabolic monochromators comprises a synthetic multilayered thin film whose d-spacing varies continuously along a parabolic-arc so as to satisfy a Bragg equation for X-rays of a predetermined wavelength at any point of said reflecting surface; and (g) a minimum distance between a focal spot of said X-ray source and said composite monochromator is less than 50 mm.

* * * * *